US005224784A

United States Patent [19]

Haftmann et al.

[11] Patent Number: 5,224,784

[45] Date of Patent: * Jul. 6, 1993

[54] ELECTRONICALLY CONTROLLED TYPEWRITER, PRINTER, OR THE LIKE AND RIBBON CASSETTE OR TYPE-WHEEL CASSETTE THEREFOR

[75] Inventors: Johannes Haftmann, Schwabach; Rudolf Schmeykal, Hemhofen, both of Fed. Rep. of Germany

[73] Assignee: TA Triumph-Adler, Nuremberg, Fed. Rep. of Germany

[ * ] Notice: The portion of the term of this patent subsequent to Mar. 6, 2008 has been disclaimed.

[21] Appl. No.: 363,978

[22] Filed: Jun. 9, 1989

[30] Foreign Application Priority Data

Jun. 10, 1988 [DE] Fed. Rep. of Germany ..... 3819783

[51] Int. Cl.[5] ..... B41J 35/28

[52] U.S. Cl. ..... 400/208; 400/242; 400/703

[58] Field of Search ..... 400/208, 207 E, 242, 400/246, 219, 219.1, 249, 703

[56] References Cited

U.S. PATENT DOCUMENTS

| | | | |
|---|---|---|---|
| 4,639,670 | 1/1987 | Normann | 324/260 |
| 4,710,044 | 12/1987 | Ackermann | 400/208 |
| 4,747,716 | 5/1988 | van er Eikel | 400/249 |
| 4,793,192 | 12/1988 | Jerger et al. | 73/861.78 |
| 4,797,016 | 1/1989 | Lahr | 400/237 |

FOREIGN PATENT DOCUMENTS

| | | | |
|---|---|---|---|
| 1611468 | 12/1970 | Fed. Rep. of Germany . | |
| 82331987.7 | 2/1984 | Fed. Rep. of Germany . | |
| 3544923 | 7/1987 | Fed. Rep. of Germany . | |
| 3706307 | 5/1988 | Fed. Rep. of Germany | 400/208 |
| 60-168688 | 9/1985 | Japan . | |
| 0022972 | 1/1986 | Japan | 400/208 |

OTHER PUBLICATIONS

"Magnetic Sensor Impulse Wires (Magnetische Sensoren Impulsdrahte," Technical Bulletin, Vacummschmelze GmbH, date unknown.

Ricoh, K. K., "Type Wheel," *Patent Abstracts of Japan*, vol. 9, No. 139, Jun. 14, 1985.

IBM Technical Disclosure Bulletin, vol. 24, No. 10, Mar. 1982.

*Primary Examiner*—Edgar S. Burr
*Assistant Examiner*—Christopher A. Bennett
*Attorney, Agent, or Firm*—Browdy and Neimark

[57] ABSTRACT

In an electrically controlled typewriter, a printer or the like it is provided that for the read-out of a magnetic coding on a rotationally driven part a sensor emits output signals in reference to a changing magnetic field. Preferably the sensor is in the form of a pulse wire. A ribbon cassette for such a typewriter is distinguished by the disposition of at least one magnet on a rotationally driven part Advantageously this is a Wiegand wire. A type wheel can be coded in a corresponding manner.

9 Claims, 3 Drawing Sheets

ELECTRONICALLY CONTROLLED TYPEWRITER, PRINTER, OR THE LIKE AND RIBBON CASSETTE OR TYPE-WHEEL CASSETTE THEREFOR

FIELD OF THE INVENTION

The invention relates to an electronically controlled typewriter, a printer or the like with an exchangeable ribbon cassette with a ribbon supply spool rotatably supported in the ribbon cassette by means of its spool core, with ribbon transport elements which move the ribbon from the direction of the ribbon supply spool across a printing area located outside of the cassette housing back into the cassette housing, and with a ribbon transport mechanism disposed in the cassette housing, which can be driven from a drive disposed on the machine via a drive wheel, a coding being disposed on a part of the ribbon cassette rotatingly driven by the drive, which coding is readable by means of a sensor on the machine. The invention is further directed to a ribbon cassette or a type-wheel cassette for such typewriter or the like.

BACKGROUND OF THE INVENTION

Such a ribbon cassette or such a typewriter or the like are known from German Patent DE-PS 35 44 923, the type of cassette being indicated by means of a coding applied to the same, here in particular in the form of an optical bar code. Optical reading of a code has the disadvantage that to a certain extent there is the possibility of interference by stray light and in particular by dirt.

From German Published Non-Examined Patent Application DE-OS 28 50 378 a type-wheel cassette is known, supplied with a which provides data regarding the content of the cassette. Read-out of the magnetized strip is performed by means of a laterally disposed movable reading head.

In type-wheel cassettes, but also in particular in ribbon cassettes, it is important that a plurality of different types of cassettes can be recognized by means of an automatically readable coding of the cassettes. For example, a so-called single-use ribbon can only be used one time and therefore is advanced by a set distance after each printing step which approximately corresponds to the width of a character. With multiple-print ribbons the advance corresponds to only one half or one third of the width of the character to be printed, therefore the electronically controlled advance depends on the type of ribbon used. Additionally, there is a requirement, for example in banking, of only using indelible ribbons, so that it should also be possible to sense whether the ribbon used is one of that type. If it is not the case, the use of such an unsuitable ribbon cassette must be prevented by the control of the typewriter.

SUMMARY OF THE INVENTION

Based on this it is an object of the invention to design a typewriter or the like, or cassettes therefor, in such a way that it is possible to code the cassettes with little effort, so that a plurality of different cassette types can be recognized. It is intended to perform the read-out simply and dependably and without the use of a separate drive mechanism.

This object is attained in a typewriter or the like of the type discussed above in that the sensor emits output pulses in reference to a changing magnetic field. The sensor is preferably in the form of a pulse wire.

Such pulse wires comprise a compound wire in which the interior switch core is kept under tensile stress by the sheath material. Parallel thereto a magnetic wire of the same length and approximately the same diameter is fixed, which assures optimal switching properties.

As magnetic switching elements, such pulse wires can emit voltage pulses up to 2 Volts without being supplied with electricity. A non-magnetizing field of only 20 A/cm is required to trigger the pulse. Of particular advantage is that the pulse amplitude is independent of the speed of the field change across a wide range. In particular a pulse is even triggered during an optionally slow field change.

With the aid of such pulse wires it is possible to realize a particularly simple triggering of the coding in typewriters of the type under discussion. The further processing of the data read-out becomes particularly easy because of the advantageous signal properties in the evaluation and memory units.

Pulse wires and their properties are described in detail in the house publication of VACUUMSCHMELZE GMBH under the title "Magnetic Sensors—Pulse Wires".

The invention also relates to a ribbon cassette for electronically controlled typewriters, printers or the like having the properties already described above.

To code such a ribbon cassette, the disposition of at least one magnet on the rotationally driven part is provided. Based on its disposition on a rotationally driven part, this magnet generates, while passing the sensor disposed on the machine in close vicinity to this rotationally driven part, a changing magnetic field and in this way and in the manner described a characteristic voltage pulse which can be used for identification. Accordingly, pulse sequences can be generated by a plurality of magnets and evaluated. Since the rotational drive of the ribbon supply spool of the ribbon cassette takes place by means of an electronically controlled step motor, the control signal for the step motor is available as a synchronization and comparator signal for the sequence in time of the coding signals emitted, so that coding and evaluation by means of the distance of the magnets in a circumferential direction and thus the sequence in time of the pulses emitted can also take place.

Advantageously it is provided that the at least one magnet is in the form of a so-called Wiegand wire. Such wires are made of ferromagnetic alloys. They are treated during manufacture in such a way that they have an exterior zone of magnetic hardness and an interior zone of relative magnetic softness. Shell and core orient themselves in the same direction under the influence of a strong magnetic field. If an element made of such a wire is inserted into a magnetic field having reverse polarity but lesser field strength, first the magnetically soft core is reversely magnetized and only when a higher magnetic field of reverse direction is provided, is the outer zone reversely magnetized. Accordingly, four different magnetized states can be realized with such a wire element, depending on the magnetic pretreatment, by either magnetizing the exterior and interior zone evenly in a first direction, or in that the interior and exterior zones have different magnetized directions opposite to each other, or finally, that both the exterior and the interior zones are magnetized in a second direction in relation to the longitudinal axis of the element. The respective polarities can be detected by means of the sensor coil provided on the machine, the voltage pulses emitted by the spool being characteristic for one of the magnetizing states previously described. It becomes clear from this that, because of the multiple possible magnetizing states of only a single such element it is possible to recognize four different types of ribbon cassettes. By means of combining several elements and by the corresponding sequence of signals during passing it is possible to realize a considerable number of different codings.

Advantageously it has been provided that the at least one magnet used for coding is disposed on the drive wheel of the ribbon cassette. This is located at a considerable outward distance in the ribbon cassette in the area of a lateral surface, so that dependable scanning by a sensor disposed in this area becomes possible.

Coding with the aid of magnets can take place in another preferred embodiment in such a way that at least two magnets are provided, having a different polarity, looking in the direction of rotation, and/or different field strength. By means of the combination of the polarization data, determined by the sign of the voltage signal at the sensor, with the field strength, which determines the signal strength, it is possible to realize as many combinations as are required for the discrimination of different types of ribbon cassettes which is important for practical use.

It may be provided within the scope of the invention that in a ribbon cassette, known per se, having a spring-biased mechanical sensing lever abutting against the supply spool and connected via a spring arrangement with a second, pivotally disposed lever in such a way that the second lever trips from a first mechanical end position into a second mechanical end position when a limiting angle of the sensing lever has been exceeded, a magnet or soft iron element is disposed at the end of the second lever which, in the second end position of the second lever, is pivoted into the area of the magnets disposed on the rotating part. By means of this a one-time ribbon end signal is generated in the sensor, or the registration of a changing magnetic field is prevented in the sensor because of the rotation of the magnets. In each case signal effects taking place in this way permit the detection of the end of the ribbon by the software.

In another embodiment it is provided to change the ribbon direction via a spool disposed at one end of a pivotable lever, this lever being spring-biased against the pull of the ribbon. At another lever end a magnet or soft iron element is disposed which, when the pull of the ribbon becomes larger than the spring force opposing it, is pivoted into an area between the magnets used for coding and a magnetically sensitive sensor.

It can be further provided in this embodiment that, when the ribbon breaks, the second lever end is brought by the effect of the spring force into a third end position, where a magnetic sensor for detecting this condition is disposed.

The invention also relates to a type-wheel cassette for a typewriter, a printer or the like, which is coded with the aid of magnets. It is possible to advantageously use the same magnets or magnet arrangements and sensor arrangements which have been described in detail above in connection with a ribbon cassette.

BRIEF DESCRIPTION OF THE DRAWINGS

Further characteristics, advantages and details of the invention ensue from the following description of a preferred embodiment in connection with the drawings, in which.

DETAILED DESCRIPTION OF THE PREFERRED EMBODIMENT

Figure 1:
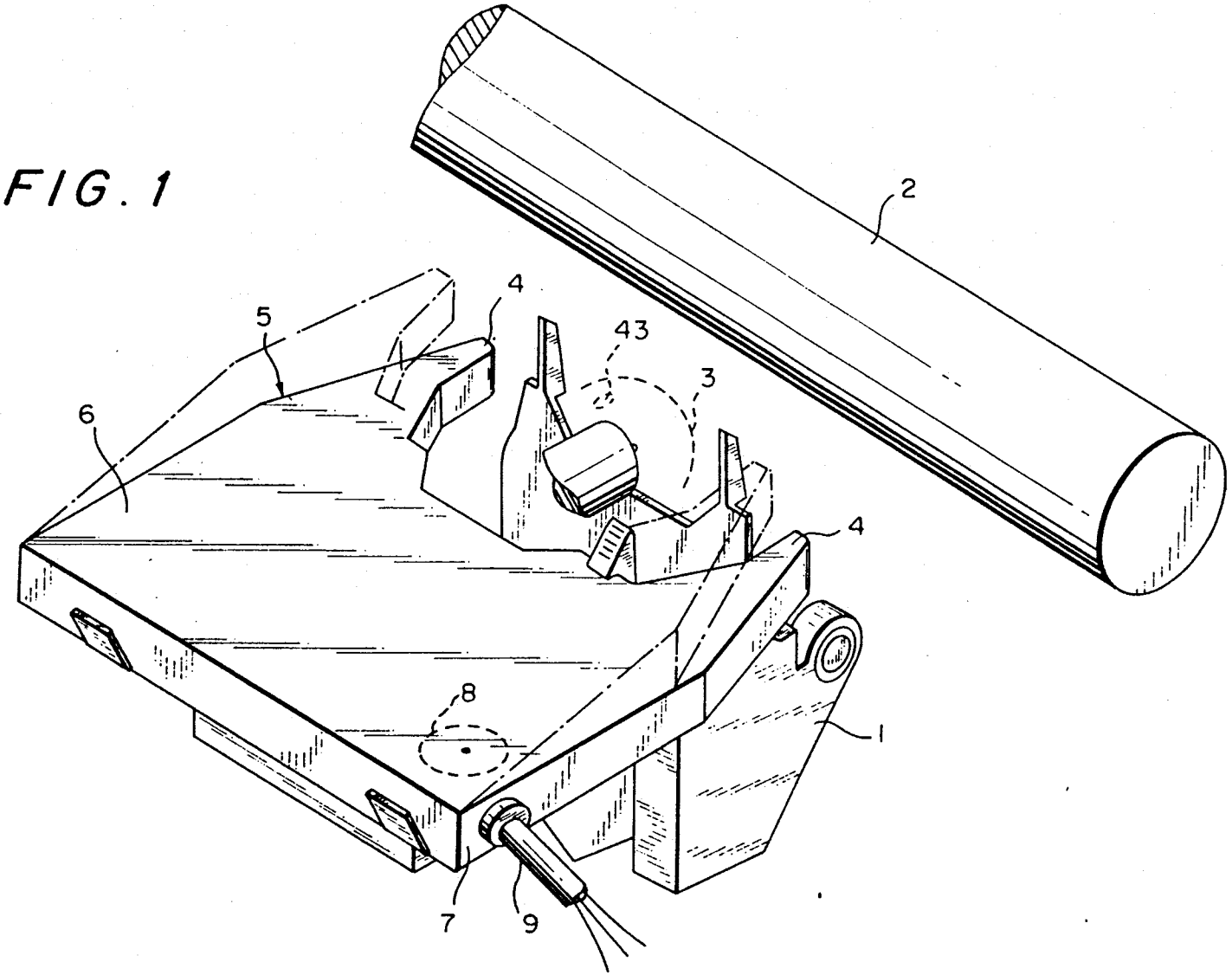
FIG. 1 is a perspective view of the most important components of a typewriter according to the invention, with a ribbon cassette according to the invention inserted therein.

A typewriter illustrated in FIG. 1 comprises a carriage 1 and a platen 2. A type wheel 3, shown only schematically and by dash-dotted lines, is disposed in the printing area between the two arms 4 of a ribbon cassette 5. The ribbon cassette 5 is exchangeable and pivotable between a position of rest, shown in solid lines, and an operating position, shown by dash-dotted lines.

The ribbon cassette 5 has a basic body 6 of approximately rectangular shape. In the area of a lateral surface 7 of this basic body, in FIGS. 1 and 2 at the right lower end where the drive wheel 10 of the cassette 5 is disposed, a sensor 9 is disposed on the machine which reacts to a changing magnetic field and which, in the exemplary embodiment, is in the form of a pulse wire, already described in detail above.

Figure 2:
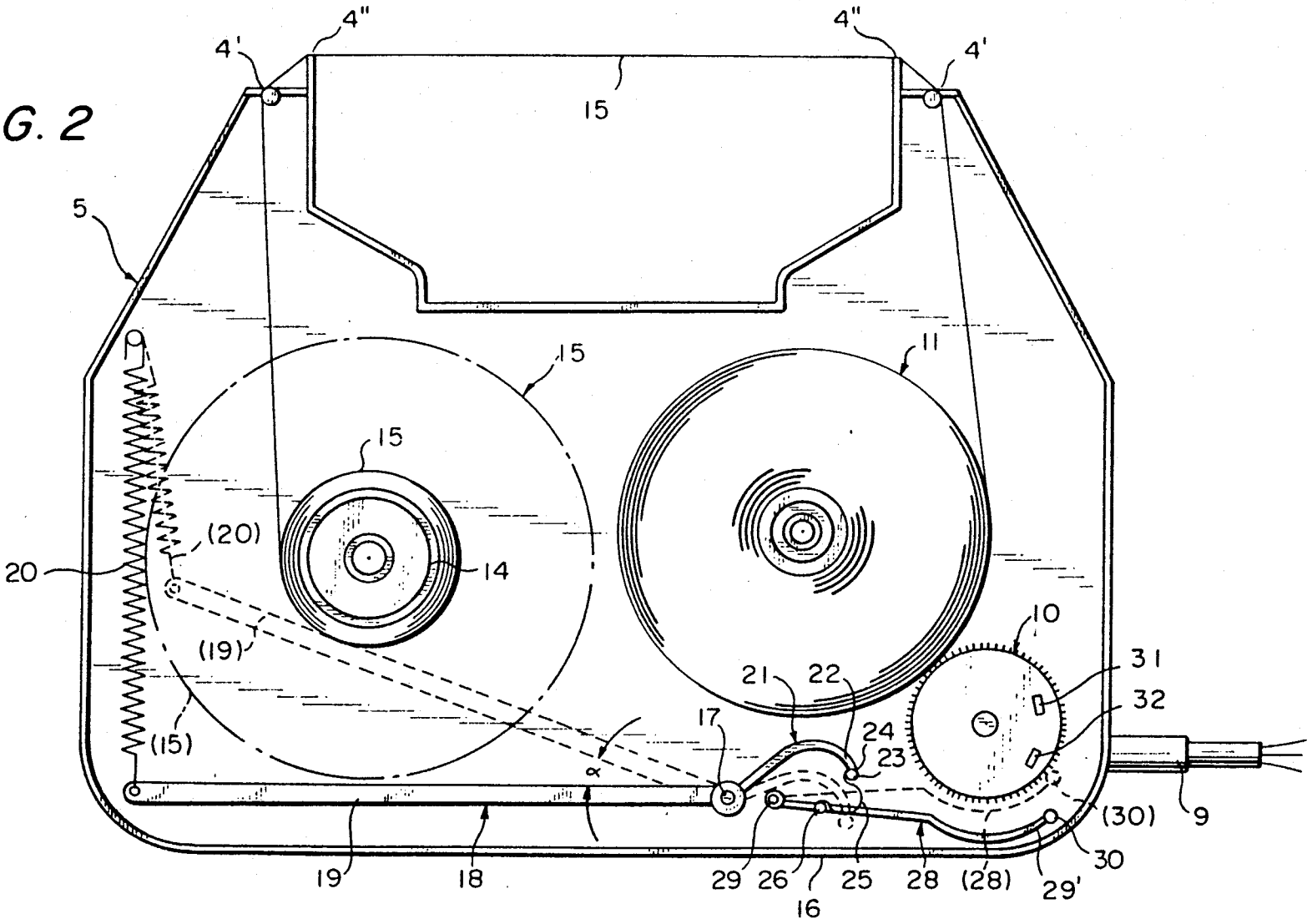
FIG. 2 is a top view of a first embodiment of a ribbon cassette according to the invention.
Figure 3:
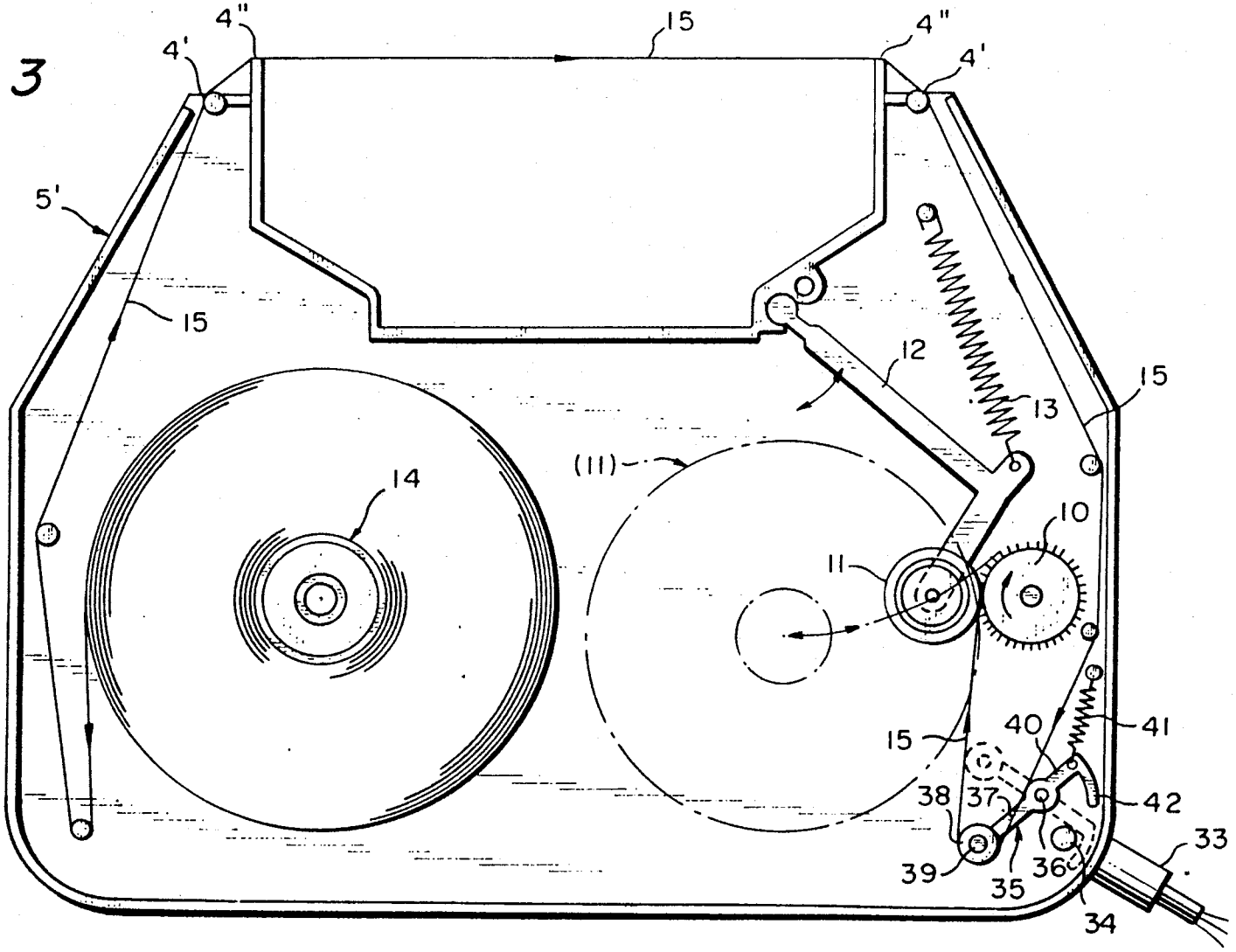
FIG. 3 is a top view corresponding to FIG. 1 of another embodiment of the present invention.

A ribbon cassette 5 and 5', shown open in FIGS. 2 and 3, respectfully comprises in a manner known per se a drive wheel 10 which is driven by a typewriter in a coordinated manner by a step motor, a receiving spool 11, also pivotally disposed in a manner known per se by means of a pivot arm 12 and a spring 13 for maintaining the constancy of the steps, and a supply core 14 from which the ribbon 15 is unwound. Ribbon transport elements 4', 4'' move the ribbon 15 from the direction of the supply core 14 across a printing area located outside of the cassette housing 5,5' back into the cassette housing 5,5'. A ribbon transport mechanism disposed in the cassette housing 5 includes a drive wheel 10 for transporting the ribbon 15 onto a receiving spool 11. The drive wheel 10 is driven from a drive disposed in the typewriter.

In the area of the base 16 of the cassette 5 a sensing lever 18 is pivotally disposed on a support pivot bolt 17, the first lever end 19 abuts under the force of a tension spring 20 against the ribbon 15 still on the supply core 14 and which is, with increasing unwinding of the ribbon 15 from the supply core 14, correspondingly pivoted by an angle $\alpha$ out of an outer position when the supply core 14 is full, shown by solid lines, into an inner position, shown by a dash-dotted line, when the ribbon 15 has been unwound.

A second lever end 21 of the sensing lever 18 on the other side of the support pivot bolt 17 is correspondingly pivoted. On the outer end 22 of this second lever end 21 a looped end 24 of a $\Omega$-shaped spring 25 is fixed over a stay bolt 23. The other end 26 of this spring 25 is connected with a further lever 28, which is laterally pivotable around a pivot support 29 adjacent to the support pivot bolt 17.

After the first lever section 19 of the sensing lever 18 has exceeded a certain limiting angle $\alpha$ as the supply core empties, the Ω-shaped spring 25 and the lever 28 with it flips out of the first stable end position, shown by solid lines, into a second stable end position shown by dash-dotted lines. Because of a magnet 30, disposed at the end 29' of the lever 28, is pivoted into the vicinity of the drive wheel 10 and thus into the vicinity of the sensor 9 on the machine, so that the latter can detect a changing, characteristic magnetic field indicating that the end of the ribbon 15 has been reached.

In the exemplary embodiment the coding of the cassette 5 to indicate its type is done in such a way that two magnets 31, 32 in the form of Wiegand wires, already previously described, are disposed on the drive wheel 10. Because of the differing sizes of these magnets 31, 32 their respective polarity it is already possible to distinguish between different types of ribbons, for example Carbon C, Carbon, Multistage, Fabric and Color Carbon C.

In the embodiment illustrated in FIG. 3 a separate sensor 33 is provided on the typewriter for detecting the end of the ribbon 15 or malfunctions in the ribbon transport. This sensor 33, too, reacts to a changing magnetic field. On the inside of the cassette 5' a Wiegand wire 34 enclosed in a glass tube is disposed opposite the sensor 33. A two-armed pivot lever 35 is pivotally disposed on a pivot bolt 36 above the Wiegand wire 34 in FIG. 3.

A guide pulley 38 is supported on a bolt 39 on one end 37 of the pivot lever 35, by means of which the ribbon 15 driven by the drive wheel 10 is reversed and brought to the receiving core 11.

A tension spring 41 acts on the other end 40 of the lever 35, which presses the lever 35 against the tension force of the ribbon 15 in FIG. 3.

If the tension force of the ribbon 15 increases when the ribbon end is reached and becomes larger than the pulling force of the spring 41, the end 37 of the lever 35 is pivoted out of the position shown in solid lines in FIG. 3 into the upper position shown by dash-dotted lines. Because of this the end 40 of the lever 35, on which a soft iron plate 42 is fixed, is pivoted between the Wiegand wire 34 and the sensor 33 on the typewriter, so that the magnetic field detected by the sensor 33 changes and it becomes possible in this way to generate a signal indicating that the end of the ribbon 15 has been reached.

The foregoing description of the specific embodiments will so fully reveal the general nature of the invention that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation.

What is claimed is:

1. A ribbon cassette for electronically controlled printing machines comprising:

an exchangeable ribbon cassette housing having a ribbon therein;

a ribbon supply rotatably supported in said ribbon cassette housing by a supply core;

ribbon transport means for supporting the ribbon across a printing area located outside of the cassette housing and in the cassette housing;

ribbon drive means disposed in the cassette housing and engaged to said ribbon transport means for moving the ribbon from the direction of the ribbon supply across said printing area located outside of the cassette housing back into the cassette housing, said ribbon drive means having a drive wheel which is driven from a drive disposed in the printing machine;

coding means for producing a magnetic field and indicating the type of ribbon cassette being used wherein said coding means is located on said drive wheel and is rotatably driven, furthermore, said coding means comprises at least two magnets being positioned to have different polarities as would be seen in the direction of rotation; and sensor means for reading said coding means wherein said sensor means comprises a pulse wire and emits output pulses as a function of a changing magnetic field.

2. A ribbon cassette in accordance with claim 1, further comprising:

a spring-biased mechanical sensing lever abutting against the ribbon supply and is connected to a spring arrangement, a second, pivotably disposed lever being connected to said spring arrangement in such a way, that the second lever trips from a first mechanical end position into a second mechanical end position when a limiting angle of the sensing lever has been exceeded; and a magnet disposed at the end of the second lever which is pivoted in the second end position of the lever into the area of the at least one magnet of said at least two magnets disposed on said drive wheel.

3. A ribbon cassette in accordance with claim 1, further comprising:

a spring-biased mechanical sensing lever abutting against the ribbon supply and is connected to a spring arrangement, a second pivotable disposed lever being connected to said spring arrangement in such a way, that the second lever trips from a first mechanical end position into a second mechanical end position when a limiting angle of the sensing lever has been exceeded; and a soft iron element disposed at the end of the second lever which is pivoted in the second end position of the lever into the area of the at least one magnet of said at least two magnets disposed on said drive wheel.

4. A ribbon cassette for electrically controlled typewriter comprising:

an exchangeable ribbon cassette housing having a ribbon therein;

a ribbon supply rotatably supported in said ribbon cassette housing by a supply core;

ribbon transport means for supporting the ribbon across a printing area located outside of the cassette housing and in the cassette housing;

ribbon drive means disposed in the cassette housing and engaged to said ribbon transport means for moving the ribbon from the direction of the ribbon supply across said printing area located outside of the cassette housing back into the cassette housing, said ribbon drive means having a drive wheel which is driven from a drive disposed in the typewriter;

coding means for producing a magnetic field and indicating the type of ribbon cassette being used wherein said coding mean is located on said drive wheel and is rotatably driven, furthermore, said coding means comprises at least two magnets being positioned to have different polarities, as would be seen in the direction of rotation; and sensor means for reading said coding means wherein said sensor means comprises a pulse wire and emits output pulses as a function of a changing magnetic field.

5. A ribbon cassette in accordance with claim 4, further comprising.

a spring-biased mechanical sensing lever abutting against the ribbon supply and is connected to a spring arrangement, a second, pivotably disposed lever being connected to said spring arrangement in such a way, that the second lever trips from a first mechanical end position into a second mechanical end position when a limiting angle of the sensing lever has been exceeded; and a magnet disposed at the end of the second lever which is pivoted in the second end position of the lever into the area of the at least one magnet of said at least two magnets disposed on said drive wheel.

6. A ribbon cassette in accordance with claim 4, further comprising:

a spring-biased mechanical sensing lever abutting against the ribbon supply and is connected to a spring arrangement, a second, pivotably disposed lever being connected to said spring arrangement in such a way, that the second lever trips from a first mechanical end position into a second mechanical end position when a limiting angle of the sensing lever has been exceeded; and a soft iron element disposed at the end of the second lever which is pivoted in the second end position of the lever into the area of the at least one magnet of said at least two magnets disposed on said drive wheel.

7. A ribbon cassette for electronically controlled printer comprising:

an exchangeable ribbon cassette housing having a ribbon therein;

a ribbon supply rotatably supported in said ribbon cassette housing by a supply core;

ribbon transport means for supporting the ribbon across a printing area located outside of the cassette housing and in the cassette housing;

ribbon drive means disposed in the cassette housing and engaged to said ribbon transport means for moving the ribbon from the direction of the ribbon supply across said printing area located outside of the cassette housing back into the cassette housing, said ribbon drive means having a drive wheel which is driven from a drive disposed in the printer;

coding means for producing a magnetic field and indicating the type of ribbon cassette being used wherein said coding means is located on said drive wheel and is rotatably driven, furthermore, said coding means comprises at least two magnets being positioned to have different polarities, as would be seen in the direction of rotation; and sensor means for reading said coding means wherein said sensor means comprises a pulse wire and emits output pluses as a function of a changing magnetic field.

8. A ribbon cassette in accordance with claim 7, further comprising:

a spring-biased mechanical sensing lever abutting against the ribbon supply and is connected to a spring arrangement, a second, pivotably disposed lever being connected to said spring arrangement in such a way, that the second lever trips from a first mechanical end position into a second mechanical end position when a limiting angle of the sensing lever has been exceeded; and a magnet disposed at the end of the second lever which is pivoted in the second end position of the lever into the area of the at least one magnet of said at least two magnets disposed on said drive wheel.

9. A ribbon cassette in accordance with claim 7, further comprising:

a spring-biased mechanical sensing lever abutting against the ribbon supply and is connected to a spring arrangement, a second, pivotably disposed lever being connected to said spring arrangement in such a way, that the second lever trips from a first mechanical end position into a second mechanical end position when a limiting angle of the sensing lever has been exceeded; and a soft iron element disposed at the end of the second lever which is pivoted in the second end position of the lever into the area of the at least one magnet of said at least two magnets disposed on said drive wheel.

* * * * *